United States Patent [19]

Tabler

[11] Patent Number: 4,890,740

[45] Date of Patent: Jan. 2, 1990

[54] SNAP TOGETHER PICKING CONTAINER

[75] Inventor: Charles P. Tabler, Hamilton, Ohio

[73] Assignee: Buckhorn, Inc., Milford, Ohio

[21] Appl. No.: 261,756

[22] Filed: Oct. 25, 1988

[51] Int. Cl.[4] ..... B65D 6/34

[52] U.S. Cl. ..... 206/509; 220/4 F; 220/345

[58] Field of Search ..... 206/509, 600; 220/4 F, 220/4 R, 6, 345

[56] References Cited

U.S. PATENT DOCUMENTS

| | | | |
|---|---|---|---|
| 628,778 | 7/1899 | Edwards | 220/4 F |
| 1,326,498 | 10/1919 | Hayden . | |
| 1,456,385 | 5/1923 | Kvarnstrom . | |
| 2,257,536 | 9/1941 | Roycroft . | |
| 2,501,980 | 3/1950 | Wolfe . | |
| 2,726,004 | 10/1955 | McLeod . | |
| 2,744,650 | 5/1956 | Voessner . | |
| 3,273,952 | 9/1966 | Himelreich et al. . | |
| 3,675,808 | 7/1972 | Brink . | |
| 3,759,412 | 9/1973 | Bush . | |
| 3,878,980 | 4/1975 | Crane | 206/509 |
| 3,887,101 | 6/1975 | Adachi | 220/4 F |
| 3,987,924 | 10/1976 | Uitz . | |
| 4,005,795 | 2/1977 | Mikkelsen et al. . | |
| 4,402,397 | 9/1983 | Spence . | |
| 4,482,074 | 11/1984 | Lalley . | |
| 4,625,879 | 12/1986 | Liu . | |

FOREIGN PATENT DOCUMENTS

| | | | |
|---|---|---|---|
| 1169103 | 12/1958 | France | 220/4 F |
| 1289410 | 2/1962 | France . | |
| 110208 | 4/1924 | Switzerland . | |
| 404595 | 7/1966 | Switzerland . | |
| 2023543 | 1/1980 | United Kingdom | 220/4 F |

*Primary Examiner*—Jimmy G. Foster

*Attorney, Agent, or Firm*—Fay, Sharpe, Beall, Fagan, Minnich & McKee

[57] ABSTRACT

A snap together picking container consists of two synthetic resin molded side members that are mirror images of each other, a folded blank of front, bottom and rear walls connected by living hinges and a sheet plastic top slid into mating grooves of the side members to abut against the rear wall. With or without the top, like containers may be stacked upon each other, with side shifting prevented by abutment flanges on the top of one container nesting between the side members of the upper container. Picking is provided through an opening due to a shortened top and a front wall shorter than the rear wall. Hook type snap assembly is provided between the walls and the side members having channels. Multiple width containers may be constructed by using inserts in the mold producing folding blank, which folded blank is shaped so as to be produced by a two part rigid plate mold without undercuts.

14 Claims, 2 Drawing Sheets

SNAP TOGETHER PICKING CONTAINER

BACKGROUND OF THE INVENTION

The present invention relates to molded plastic containers, particularly picking type storage containers or bins, such as shown in U.S. Pat. No. 3,259,269, issued Jul. 5, 1966.

SUMMARY OF THE INVENTION

It is an object of the present invention to provide a multi part plastic storage and picking bin or container that may be warehoused and shipped in flat space saving unassembled package and thereafter assembled by the user or distributor. It is a further object of the present invention to provide a molded synthetic resin picking container that may be molded from molds of reduced cost, even for sets of multiple size containers.

A snap together picking container consists of two synthetic resin molded side members that are mirror images of each other, a folded blank of front, bottom and rear walls connected by living hinges and a sheet plastic top slid into mating grooves of the side members to abut against the rear wall. With or without the top, like containers may be stacked upon each other, with side shifting prevented by abutment flanges on the top of one container nesting between the side members of the upper container. Picking is provided through an opening due to a shortened top and a front wall shorter than the rear wall. Hook type snap assembly is provided between the walls and the side members having channels. Multiple width containers may be constructed by using inserts in the mold producing folding blank, which folded blank is shaped so as to be produced by a two part rigid plate mold without undercuts.

BRIEF DESCRIPTION OF THE DRAWINGS

Further objects, features and advantages of the present invention will become more clear from the following detailed description of a preferred embodiment, shown in the drawing, wherein.

DETAILED DESCRIPTION OF THE PREFERRED EMBODIMENT

Figure 1A:
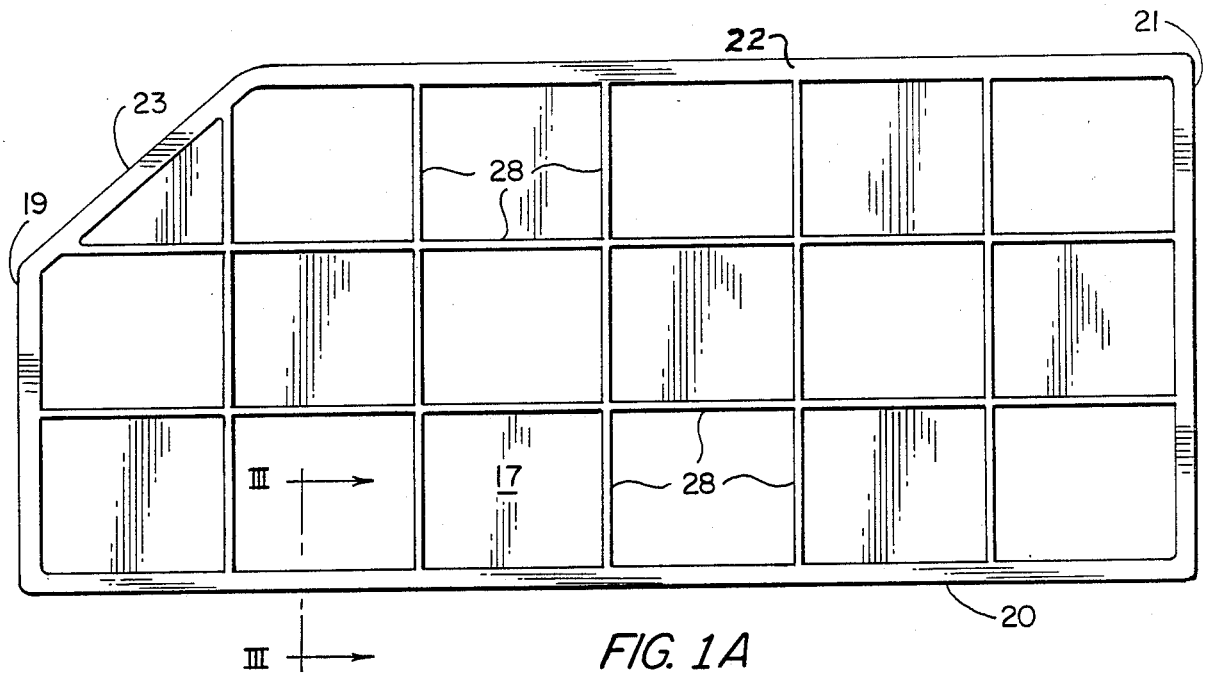
FIG. 1A is a side elevation view of the container of the present invention, with the other side being a mirror image.

The picking and storage container or bin of the present invention is entirely constructed of synthetic resin material, and consists of only four parts per bin, namely two mirror image side members 1 and 2, a folded blank 3, and a top 4. Each of the side members 1, 2 is a single one-piece homogeous molded synthetic resin part. The folded blank is a single one-piece homogeneous molded synthetic resin part comprising a front wall 4, a bottom wall 5, a rear wall 6, and reduced thickness hinges, so called living-hinges, 7, 8. The top 4 is a single flat planar one-piece homogenous molded synthetic resin sheet, which may be stamped from flat sheets or otherwise cut from flat or rolled sheet material.

The connection between the folded blank and the side members is a snap type connection. The connection is only formed from portions of the side members and the folded blank, which portions are integrally formed in one piece on the side members 1, 2 and the folded blank 3 for connecting one side of the front wall 4, the bottom wall 5 and the rear wall 6 that is adjacent the side member 1 to the side member 1 and for connecting the other side of the front wall 4, the bottom wall 5 and rear wall 6 that is adjacent the side member 2 to the side member 2.

Figure 3:
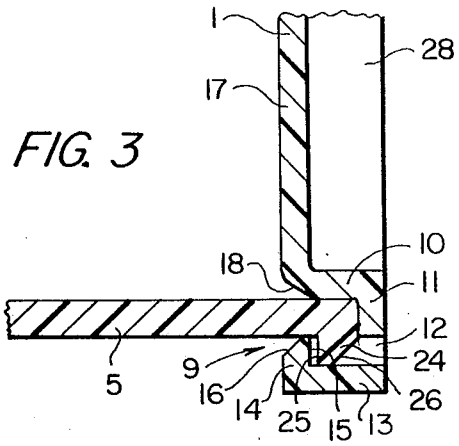
FIG. 3 is a partial cross-sectional view taken along line III—III of FIG. 1.
Figure 1B:
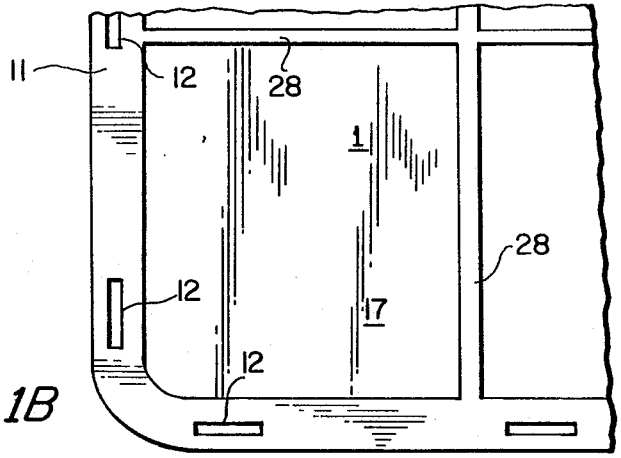
FIG. 1B shows a partial side view of a side member of the invention.

The connection includes a U-shaped channel 9, particularly shown in FIG. 3. The channel is made up of an inside leg portion 10, a web portion 11, a plurality of apertures 12 spaced along the web portion 11 and being of rectangular uniform shape, and outer leg 13. The outer leg 13 is provided with a plurality of hooks 14 that extend inwardly of the channel and form an inwardly facing abutment surface 15 and an outwardly facing cam surface 16, with respect to the inside of the channel. The inner leg 10 of the channel is connected integrally to the adjacent edge of a body portion 17 of the side member 1, and at such connection there is a cam surface 18 complementary to the cam surface 16 to form a wedge entrance to the channel. The hook 14 is completely coextensive, that is rectangularly and of identical dimensions, with the aperture 12, so that there are no undercut portions. The connection may be made entirely with a two part rigid mold, particularly two flat plates milled or otherwise formed without undercuts. This connection channel extends completely around the front edge 19, bottom edge 20 and rear edge 21 of the side member 1 for connection with the folded blank, and may extend additionally along the major portion 22 of the top edge that is parallel to the bottom edge 21 and along a minor portion 23 of the top edge that leads from a major portion 22 to the front edge 19. The channel along the major portion 22 and minor portion 23 is preferably of simpler construction, that is without the hook 14 having surfaces 15 and 16.

Figure 2:
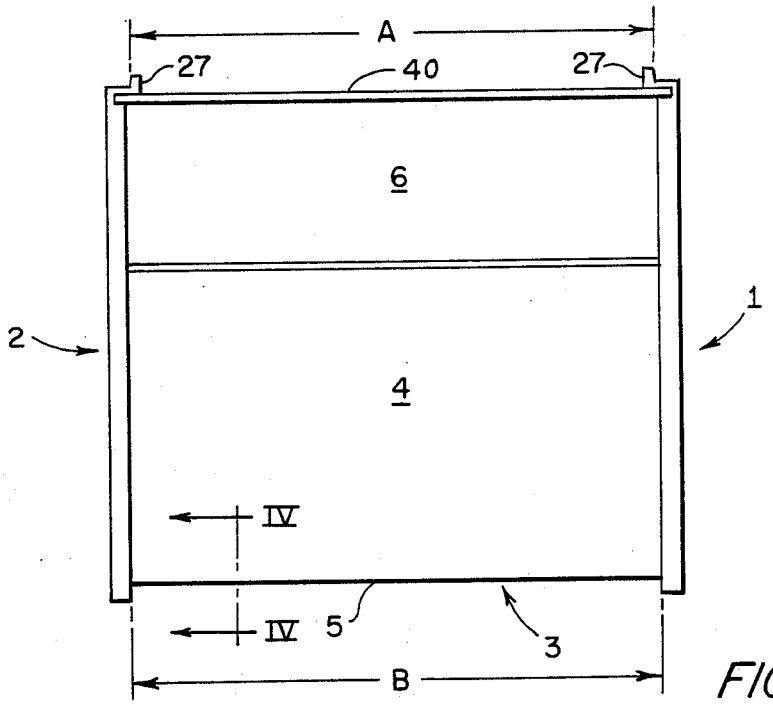
FIG. 2 is a front view of the container of FIG. 1.
Figure 4:
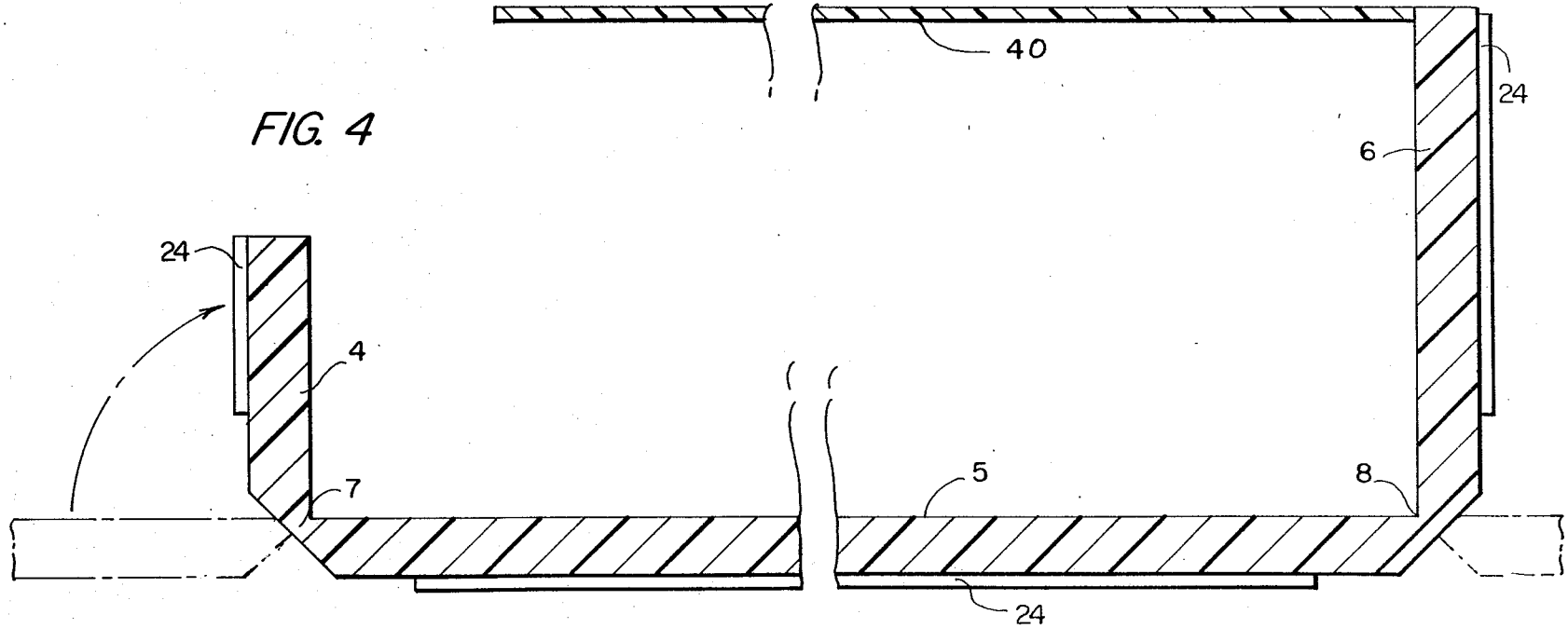
FIG. 4 is a cross-sectional view taken along line IV—IV of FIG. 2, with the side member removed.

The channel along the major portion of the top edge 22 of each side member 1 may be a simple rectangular channel as shown in FIG. 2 to extend horizontally as a groove inwardly opening and open towards the front for receiving therein the top 40, with sliding engagement, so that the top 40 may be assembled and removed from the front. The top 40 abuts against the overlapping rear wall 6 as shown in FIG. 4. Since the front wall 4 extends to a lesser height than the rear wall 6, and the top extends only along the major portion 22, there is a slanted opening between minor edge portions 23 through which the contents of the container may be picked, or alternatively the top 40 may be completely removed for supply of additional contents or greater ease in picking; in such case the container would consist of three parts.

The remainder of the connection is formed by a hook 24 extending from the side edge of each of the front wall 4, bottom 5, and rear wall 6. The hook 24 extends in the opposite direction to the extent of the hook 14, as shown in FIG. 3, within the channel in the assembled position. The hook 24 has a planar abutment surface portion 25 coplanar with the abutment surface portion 15 of the hook 14 to form engaging portions that face each other and engage each other to prevent disassembly of the connection without the aid of tools. The hook 24 is further provided with a cam surface 26 complementary to the cam surface 16 of the hook 14, which cam surfaces 26 and 16 face away from each other, in the assembled position. The cam surfaces 16 and 26 wedgingly engage for spreading apart the channel during movement of the front wall, bottom wall 5 and rear wall 6 into the channel during assembly. During this assembly, the cam surface 18 further assists in such spreading apart of the channel and such assembly in a snap fashion.

As shown in FIG. 2, the top edge of the major portion 22 has an upstanding abutment flange 27 spaced inwardly from the remainder of the side wall 1, 2. The horizontal spacing between outer portions of the abutment flanges 27, in the assembled position, being at least equal to the horizontal spacing B between inner portions of the channels of the two side members 1, 2, more particularly between the opposed hooks 14 as shown in FIG. 2. This structure permits stacking of like containers upon each other, with or without tops, with the channels that are adjacent the bottom wall, as shown in FIG. 3, receiving therebetween the flanges 27 of a lower container to prevent side to side shifting of the stacked containers or bins.

The folded blank, in its unstressed condition before assembly, would be in the dotted line position for the front wall 4 and rear wall 6, which would be coextensive with the bottom wall 5 as shown in FIG. 4, with the reduced thickness hinge portions merely being parallel notches completely extending from one side to the other side of the blank at the two locations between adjacent walls. The hook 24 is merely an upstanding type flange, extending outwardly of the sheet material forming the remainder of the walls 4, 5, 6 in contrast to the reduced diameter portion that is a slot or channel extending inwardly of the sheets forming the walls 4, 5, 6. Therefore, it is seen that the folded blank may be molded from a mold consisting of only two flat plates with grooves to form the complementary structure. These flat plates may then be cut along a common line, for example the cross section line of FIG. 4 or some other line parallel to it so that upper and lower insert mold plates may be inserted between the cut portions, which insert plates would be identical in the cross-section to the cross-section shown in FIG. 4, including the dotted lines, so that different side to side width folded blanks may be produced with a single mold and insert plates.

In addition to the structure previously recited, the side members 1 and 2 contain a plurality of reinforcing ribs 28 extending perpendicularly from the body portion of the side members and parallel to the legs 10, 13 of the channels. In this manner, it can be seen that each side member is constructed only of a planar sheet main body portion and flanges extending parallel or perpendicular thereto, so that the side members may be each constructed of a plate mold consisting of only two flat plates milled with the appropriate flanges to produce the complementary structure. In fact, a computer program or the like used to mill the flat plates for one side member can easily be transposed or transformed to mill the mirror image to produce the mold for the other side member. For comparison purposes, at current prices, the cost of the molds for a conventional plastic bin of this type would be approximately $120,000, as compared to $35,000 for the cost of the molds to produce the bin of the present invention.

A further advantage of the present invention is that the bins may be shipped in knock down condition so that effectively air is not being shipped. That is, the shipping volume can be greatly reduced. With the use of the mold insert, sets of various width molded blanks may be employed and combined with the single size side members to produce different size bins, for example an eight inch wide bin or a 16 inch wide bin. Since there is no molding draft, that are no slanted sides to the molds for mold release for good space utilization. With no undercuts, the molds are easily produced by simple two dimensional milling of flat plates.

To the extent that the present container has been illustrated as consisting of four parts, it is certainly understood that more simply it consist of only three parts, because the top is not necessary. Further, the top may be provided with an extension to cover the minor edge portions 23 and completely cover the opening therebetween, which top extension would be connected to the illustrated top 4 with a hinge 7 and provided with some type of latch, for example a hook, for engagement with the front wall 4 to hold it in its closed position. Such top extension would be molded coplanar with the illustrated top 4, so that its normal unhooked position would be coextensive with the top 4 for easy picking of contents of the container.

The parts are shipped in a flat, high cube utilization, condition. Field assembly will be achieved by bending the folded blank, at the living hinge lines, to form a somewhat U-shape. Sides will then be applied by a light pressure to engage the interlocks, or channel and hook portions. The bin or container is not intended to be knocked down once assembled. However, knocking down could be accomplished with tools.

The bottom mold is molded in two widths in a common mold using inserts. These inserts can be designed to produce almost any width. Further features of the present invention include guides to prevent lateral shifting of stacked containers, which guides are specifically illustrated in the preferred embodiment as flanges 27. Stops prevent longitudinal shifting of stacked containers, particularly the rear wall could be extended above the top wall 4 and the channel along the bottom edge of each of the side members 1, 2 could be appropriately cut out for receiving the rear wall 6 of a lower container in the stacked condition. The top may be the illustrated plastic sheet material, or cardboard, or any appropriate material provided by the user, and easily shipped or easily obtained onsite for component protection. Even though the top is separate, and subject to loss, it can be easily replaced by any sheet material.

A hopper front facilitates picking from the flow racks or shells containing a plurality of containers. The flat bottom facilitates conveying on conveyor rollers or wheel type conveyors. The container maximizes the use of flow rack area and optimizes open shelf spacing, because there is no draft, that is the side members front wall and rear wall extend vertically, and the top and bottom extend horizontally. The containers will be less expensive due to reduced molding cost, reduced shipping cost, reduced inventory since common side members may fit different size folded blanks to produce different size containers, and simple assembly.

While a preferred embodiment has been illustrated as the best mode of accomplishing the present invention and for the advantages of the specific features, variations, modifications and further embodiments are contemplated according to the broader aspects of the present invention, all as set forth in the spirit and scope of the following claims.

I claim:

1. A synthetic resin picking and storage container, comprising:

two separate side members that are mirror images of each other, and each of said sides being a single one-piece homogenous molded synthetic resin part;

a front wall, a bottom wall, a rear wall, and reduced thickness hinge means integrally connecting together all of said walls to constitute a single one-piece homogenous molded synthetic resin folded blank;

said side members and walls each having interengaging connection means integrally formed in one piece on said side member and walls for connecting one side of said front, bottom and rear walls to one of said side members and the other side of said front, bottom and rear walls to the other of said side members;

said connection means including a U-shaped channel around the front, bottom and rear edges of each of said side members containing therein the adjacent edge of said front wall, bottom wall and rear wall, respectively; and said connection means including channel hook means extending from the free edge of said channel inwardly of said channel in one direction, and wall hook means extending in the opposite direction from the edge of each of said front wall, bottom wall and side wall within said channel between the web portion of said channel and said channel hook means.

2. A container according to claim 1, including said channel hook means and said wall hook means each having substantially coplanar engaging portions facing each other and complementary cam surfaces facing away from each other to provide means wedgingly engaging for spreading apart said channel during movement of said front wall, bottom wall and rear wall into said channel during assembly.

3. A container according to claim 2, including said channel hook means being provided as a plurality of spaced apart separate hooks, a plurality of apertures, substantially coextensive with and corresponding in number to said hooks, with said apertures being in said web portion of said channels to facilitate molding said hooks in a two part mold without undercutting.

4. A container according to claim 1, including each of said side members having a planar continuous body portion, a plurality of reinforcing ribs throughout said body portion and extending perpendicularly outwardly from said body portion, and said channel extending from the perimeter of said body portion outwardly a distance substantially equal to said ribs.

5. A container according to claim 4, including said front wall being of substantially less height than said rear wall; said each of said side members having a top edge extending from said rear wall parallel to said bottom wall for a first major portion and then angularly downward to the top edge of said front wall.

6. A container according to claim 5, including the top edge of said major portion having a horizontally extending groove, inwardly opening and open towards the front; and a rectangular planar synthetic resin top being slidably received within said groove and having a rear edge abutting said rear wall.

7. A container according to claim 6, including said top edge of said major portion having an upstanding abutment flange spaced inwardly from the remainder of said side wall with the horizontal spacing between outer portions of said abutment flange being at least equal to the horizontal spacing between inner portions of said correction means channel so that like containers, with or without tops, may be stacked upon each other with said channels adjacent said bottom wall receiving therebetween said flanges to prevent side to side shifting of the stacked containers.

8. A synthetic resin picking and storage container, comprising:

two separate side members that are mirror images of each other, and each of said sides being a single one-piece homogenous molded synthetic resin part;

a front wall, a bottom wall, a rear wall, and reduced thickness hinge means integrally connecting together all of said walls to constitute a single one-piece homogenous molded synthetic resin folded blank;

said side members and walls each having interengaging connection means integrally formed in one piece on said side member and walls for connecting one side of said front, bottom and rear walls to one of said side members and the other side of said front, bottom and rear walls to the other of said side members;

a second folded blank identical to said first mentioned folded blank except for having a greater side to side width to form an interchangeable set of blanks for selectively forming different size containers with said side members.

9. A container according to claim 8, wherein said reduced thickness hinge means, in their unstressed condition of disassembly of said container, normally maintains said front wall, said bottom wall and said rear wall coplanar; each of said front wall, bottom wall and rear wall apart from said hinge means and connection means being only of a single thickness planar rectangular sheet; said reduced thickness hinge means being a channel shaped connection portion between adjacent sheets, and said connection means having no undercut portions for molding from a rigid two part mold, so that said folded blank may be molded entirely from only two configured rigid plates of a plate mold.

10. A container according to claim 9, including said connection means includes a U-shaped channel around the front, bottom and rear edges of each of said side members containing therein the adjacent edge of said front wall, bottom wall and rear wall, respectively; said connection means including channel hook means extending from the free edge of said channel inwardly of said channel in one direction, and wall hook means extending in the opposite direction from the edge of each of said front wall, bottom wall and side wall within said channel between the web portion of said channel and said channel hook means; and said channel hook means being provided as a plurality of spaced apart separate hooks, a plurality of apertures, substantially coextensive with and corresponding in number to said hooks, with said apertures being in said web portion of said channels to facilitate molding said hooks in a two part mold without undercutting.

11. A container according to claim 1, including a second folded blank identical to said first mentioned folded blank except for having a greater side to side width to form an interchangeable set of blanks for selectively forming different size containers with said side members.

12. A synthetic resin picking and storage container, comprising:

two separate side members that are mirror images of each other, and each of said sides being a single one-piece homogenous molded synthetic resin part;

a front wall, a bottom wall, a rear wall, and reduced thickness hinge means integrally connecting together all of said walls to constitute a single one-piece homogenous molded synthetic resin folded blank;

said side members and walls each having interengaging connection means integrally formed in one piece on said side member and walls for connecting one side of said front, bottom and rear walls to one of said side members and the other side of said front, bottom and rear walls to the other of said side members;

said front wall being of substantially less height than said rear wall;

said each of side members having a top edge extending from said rear wall parallel to said bottom wall for a first major portion and then angularly downward to the top edge of said front wall;

the top edge of said major portion having a horizontally extending groove, inwardly opening and open towards the front; and a rectangular planar synthetic resin top being slidably received within said groove and having a rear edge abutting said rear wall.

13. A container according to claim 12, including a second folded blank identical to said first mentioned folded blank except for having a greater side to side width to form an interchangeable set of blanks for selectively forming different size containers with said side members.

14. A synthetic resin picking and storage container, comprising:

two separate side members that are mirror images of each other, and each of said sides being a single one-piece homogenous molded synthetic resin part;

a front wall, a bottom wall, a rear wall, and reduced thickness hinge means integrally connecting together all of said walls to constitute a single one-piece homogenous molded synthetic resin folded blank;

said side members and walls each having interengaging connection means integrally formed in one piece on said side member and walls for connecting one side of said front, bottom and rear walls to one of said side members and the other side of said front, bottom and rear walls to the other of said side members;

said front wall being of substantially less height than said rear wall;

said each of side members having a top edge extending from said rear wall parallel to said bottom wall for a first major portion and then angularly downward to the top edge of said front wall; and said top edge of said major portion having an upstanding abutment flange spaced inwardly from the remainder of said side wall with the horizontal spacing between outer portions of said abutment flange being at least equal to the horizontal spacing between inner portions of said correction means channel so that like containers, with or without tops, may be stacked upon each other said channels adjacent said bottom wall receiving therebetween said flanges to prevent side to side shifting of the stacked containers.

* * * * *